US012454395B2

(12) United States Patent
Wisniewski et al.

(10) Patent No.: US 12,454,395 B2
(45) Date of Patent: Oct. 28, 2025

(54) DISPENSING CLOSURE

(71) Applicant: AptarGroup, Inc., Crystal Lake, IL (US)

(72) Inventors: John Wisniewski, Wauwatosa, WI (US); Timothy Michael Mazurkiewicz, Waukesha, WI (US)

(73) Assignee: AptarGroup, Inc., Crystal Lake, IL (US)

( * ) Notice: Subject to any disclaimer, the term of this patent is extended or adjusted under 35 U.S.C. 154(b) by 35 days.

(21) Appl. No.: 18/579,754

(22) PCT Filed: Aug. 1, 2022

(86) PCT No.: PCT/US2022/038998

§ 371 (c)(1),
(2) Date: Jan. 16, 2024

(87) PCT Pub. No.: WO2023/014627

PCT Pub. Date: Feb. 9, 2023

(65) Prior Publication Data

US 2024/0327079 A1 Oct. 3, 2024

Related U.S. Application Data

(60) Provisional application No. 63/228,388, filed on Aug. 2, 2021.

(51) Int. Cl.
*B65D 47/10* (2006.01)
*B65D 47/08* (2006.01)

(52) U.S. Cl.
CPC ..... *B65D 47/103* (2013.01); *B65D 47/0804* (2013.01); *B65D 2401/25* (2020.05)

(58) Field of Classification Search
CPC ..... B65D 47/103; B65D 47/0804; B65D 2401/25
See application file for complete search history.

(56) References Cited

U.S. PATENT DOCUMENTS 5,755,360 A 5/1998 Elliott
6,851,586 B2 2/2005 Ode
(Continued)

OTHER PUBLICATIONS

International Search Report and Written Opinion dated Oct. 28, 2022 for PCT/US2022/038998, of which this is the U.S. national phase application.

*Primary Examiner* — James N Smalley
(74) *Attorney, Agent, or Firm* — Wood, Phillips, Katz Clark & Mortimer

(57) ABSTRACT

A dispensing closure (40, 40A, 40B) defines a central axis and has a first body (54, 54A, 54B) for being located at an opening of a container. The first body (54, 54A, 54B) having a first peripheral wall (56, 56A, 56B) and a membrane (60, 60A, 60B) that is connected to the first peripheral wall (56, 56A, 56B) to initially occlude access to the interior of the container. The membrane (60, 60A, 60B) includes a separation member (62, 62A, 62B) that accommodates engagement by a user to separate the membrane (60, 60A, 60B) from the first peripheral wall (56, 56A, 56B) to permit access to the interior of the container. The membrane (60, 60A, 60B) has an annular peripheral portion (68, 68A, 68B) adjacent the first peripheral wall (56, 56A, 56B) that slopes axially outwardly along the central axis in a radial direction moving away from the first peripheral wall (56, 56A, 56B) toward the central axis.

16 Claims, 12 Drawing Sheets

(56) References Cited

U.S. PATENT DOCUMENTS

| | | | | |
|---|---|---|---|---|
| 10,954,023 | B2 * | 3/2021 | Winberg | B65D 5/065 |
| 2001/0015355 | A1 * | 8/2001 | Adams | B65D 47/103 220/259.3 |
| 2005/0092750 | A1 * | 5/2005 | Lohrman | B65D 47/36 215/254 |
| 2007/0221605 | A1 | 9/2007 | Pugne et al. | |
| 2009/0084814 | A1 | 4/2009 | Wisniewski et al. | |
| 2010/0140268 | A1 * | 6/2010 | Lohrman | B65D 47/103 220/270 |
| 2011/0011821 | A1 | 1/2011 | Lohrman et al. | |
| 2014/0319142 | A1 | 10/2014 | Johansson et al. | |
| 2016/0023819 | A1 | 1/2016 | Maldonado | |

* cited by examiner

DISPENSING CLOSURE

PRIORITY

The present application claims priority from U.S. Provisional Patent Application No. 63/228,388, filed on Aug. 2, 2021, the entire contents of which is incorporated herein by reference.

TECHNICAL FIELD

The present invention relates generally to a dispensing closure for use with a container of a fluent substance.

BACKGROUND OF THE INVENTION AND TECHNICAL PROBLEMS POSED BY THE PRIOR ART

Closures are employed to selectively prevent or permit communication of a substance between the interior and the exterior of a container (e.g., flexible pouch, rigid bottle, machine, dispensing equipment, containment system, etc.) through an opening in the container. Various fluent and non-fluent substances (including lotions, creams, food items, granules, liquids, powders, small articles, etc.) may be packaged in a container. A typical closure includes a (1) body (e.g., screw or snap-fit base, pouch fitment, structure, etc.) located at an opening to the container interior, and (2) a closing element (e.g., a lid, cover, overcap, etc.).

The closure body can typically be either (1) a separate structure that (a) can be attached at such a container opening, and (b) defines at least one access passage through the body for communicating through such a container opening with the interior of such a container, or (2) an integral structure that is a unitary portion of such a container and that defines at least one access passage through the integral structure such that the access passage functions as the opening, per se, to the container.

The closing element typically accommodates movement relative to the body access passage between (1) a closed position occluding the access passage, and (2) an open position at least partially exposing the access passage. Some closures may include additional elements (e.g., tamper-evident features, silicone valves, locking elements, seals, etc.).

A closure specifically designed for dispensing a fluent substance may be described as a dispensing closure. Various fluent materials or substances (including oils, lotions, creams, gels, liquids, food items, granules, powders, etc.) may be packaged in a rigid, flexible, or collapsible container having a dispensing closure that can be opened and closed. A flexible container may be pressurized by a user to force the fluent substance from the container and through the closure body to dispense the fluent substance at a target region or onto a target surface area. The container with the closure mounted thereon, and the contents stored therein, may be characterized as a "package."

A dispensing closure may provide an initial hermetic seal and/or may provide an initial tamper-evidency for indicating to a user that the closure integrity has been compromised. One such type of closure includes a body having a discharge end defining at least part of the access passage (which could be, for example, a discharge flow passage) that is initially sealed closed with a separable membrane. The discharge end of the body may further be covered with a closing element that is a cap or lid that can be removed, or moved away, from the discharge end so as to "open" the discharge end and allow access to the separable membrane. Typically, a separation member, such as a pull tab or pull ring, extends from the membrane. The pull tab or ring projects above the membrane. The user initially grasps the pull tab or ring to pull the membrane so as to separate the membrane from the body discharge end at the access passage to establish communication between the exterior ambient environment and the interior of the container or other system to which the closure is mounted. A frangible connection or tear path defines the line of separation between the membrane and the remaining portion of the closure body.

The inventors of the present invention have determined that it would be desirable to provide, at least for some applications, an improved dispensing closure that includes a separable membrane located within a relatively smaller dispensing orifice that exhibits an improved visual appearance to a user.

The inventors of the present invention have also determined that it would be desirable to provide an improved dispensing closure with a separable membrane exhibiting improved performance in separating from the remainder of the closure body and/or exhibiting a decreased force required by a user to initiate the tear or separation of the membrane from the remainder of the closure body.

The inventors of the present invention have also found that it would be desirable to provide, at least for some applications, an improved dispensing closure that can be manufactured and/or assembled at a relatively low cost, and can accommodate manufacture by means of efficient, high-speed, large-volume techniques, and that can facilitate the minimization of plastic part weight.

The inventors of the present invention have discovered how to provide such an improved dispensing closure that includes novel, advantageous features not heretofore taught or contemplated by the prior art, and which can accommodate designs having one or more of the above-discussed benefits or features.

SUMMARY OF THE INVENTION

According to broad aspects of one form of the present invention, a dispensing closure is provided for use in dispensing a substance that may be stored within an interior of a container. The closure defines a central axis extending inwardly toward the container interior and outwardly away from the container interior and includes a first body for being located at an opening of a container. The first body has a first peripheral wall and a membrane that is connected to the first peripheral wall to initially occlude access to the interior of the container. The membrane further includes a separation member that accommodates engagement by a user to separate the membrane from the first peripheral wall to permit access to the interior of the container. The membrane has an annular peripheral portion adjacent the first peripheral wall that slopes axially outwardly along the central axis in a radial direction, moving away from the first peripheral wall toward the central axis.

In one form of the present invention, the first body includes a second peripheral wall connected to, and surrounding, the first peripheral wall. The first and second peripheral walls function to receive a portion of the container to secure the first body at the opening of the container.

In another form of the present invention, the separation member includes at least one stem extending axially outwardly from the membrane and a grippable ring extending laterally from the stem.

In yet another form of the present invention, the membrane includes a concave, central portion that slopes axially inwardly from the annular peripheral portion.

According to another form of the present invention, the closure further includes a second body for surrounding at least a portion of the first body and which defines a dispensing orifice. In one preferred form, the second body includes a top deck and a pair of concentric walls extending axially inwardly from the top deck toward the membrane. In another preferred form of the present invention, one of the pair of concentric walls engages the first peripheral wall of the first body, and the other one of the pair of concentric walls is located above the annular peripheral portion of the membrane when the first and second bodies are in an assembled configuration on a container which would be encountered by a user of the closure. Still preferably, at least one of the pair of concentric walls conceals the connection of the annular peripheral portion to the first peripheral wall of the first body.

According to yet another form of the present invention, the membrane defines a first diameter at the connection between the annular peripheral portion and the first peripheral wall, and the dispensing orifice defines a second diameter that is smaller than the first diameter, both diameters being measured in a plane that is normal to the central axis of the closure.

According to another aspect of the present invention, the second body includes a top deck and a skirt which extends downwardly from the top deck for surrounding a portion of the container. The second body further includes a lid rotatably connected to the top deck.

According to another preferred form of the present invention, the second body includes a pour lip extending laterally and axially outwardly around the dispensing orifice and defining a pour path. Advantageously, the separation member may be asymmetric relative to a plane extending through said central axis and the pour path.

In one form of the present invention, the second body includes means for being non-removably secured with the first body at an opening of the container. Preferably, the means include a flexible flange or band.

In still another form of the present invention, the dispensing closure, including the first and second bodies, is provided in combination with a container of a fluent substance, wherein the closure, container, and the fluent substance together define a package.

In yet another form of the present invention, the membrane includes at least one bend point located at an axially outermost end of the peripheral portion for encouraging folding of the membrane.

According to another preferred form of the present invention, the second body includes a top deck having a flexible seal extending axially inwardly therefrom for sealing against the first body.

In one form of the present invention, the second body includes a pour lip that is symmetric about the central axis.

According to another broad aspect of one form of the present invention, a dispensing closure is provided for use in dispensing a substance that may be stored within an interior of a container. The closure includes a first body having a first peripheral wall for being located adjacent the container opening, a membrane for being located across the container opening, and a frangible connection connecting the membrane with the first peripheral wall to initially occlude access to the interior of the container. The membrane further includes a separation member that accommodates engagement by a user to separate the membrane from the first peripheral wall to permit access to the interior of the container. The membrane has a peripheral portion that extends from the frangible connection in a direction toward the exterior of the closure (away from the interior of the container).

It should be appreciated that the invention may include any or all of the above-described features, include only one of the above-described features, more than one of the above-described features, and any combination of the above-described features. Furthermore, other objects, features and advantages of the invention will become apparent from a review of the entire specification including the appended claims and drawings.

BRIEF DESCRIPTION OF THE DRAWINGS

FIG. 1 shows the closure with the lid in an open position to expose the pull ring of a separable membrane that is occluding a dispensing orifice of the closure;

FIG. 4 illustrates the grippable ring moved axially outwardly when initially grasped by a user of the dispensing closure;

FIG. 5 illustrates the grippable ring moved further axially outwardly to initiate a tear in the frangible connection between the membrane and the remainder of the fitment;

FIG. 7 illustrates that the membrane has been completely removed from the interior of the closure to permit flow through the dispensing orifice;

FIG. 8 illustrates that the membrane has been completely removed by a user from the interior of the closure to permit flow through the dispensing orifice;

FIG. 10 shows omits the lid of the closure for improved clarity;

FIG. 13 illustrates that the lid has been opened to expose the separable membrane.

DESCRIPTION OF THE PREFERRED EMBODIMENTS

While this invention is susceptible of embodiment in many different forms, this specification and the accompanying drawings disclose only specific forms as examples of the invention. The invention is not intended to be limited to the embodiments so described, and the scope of the invention will be pointed out in the appended claims.

Figure 1:
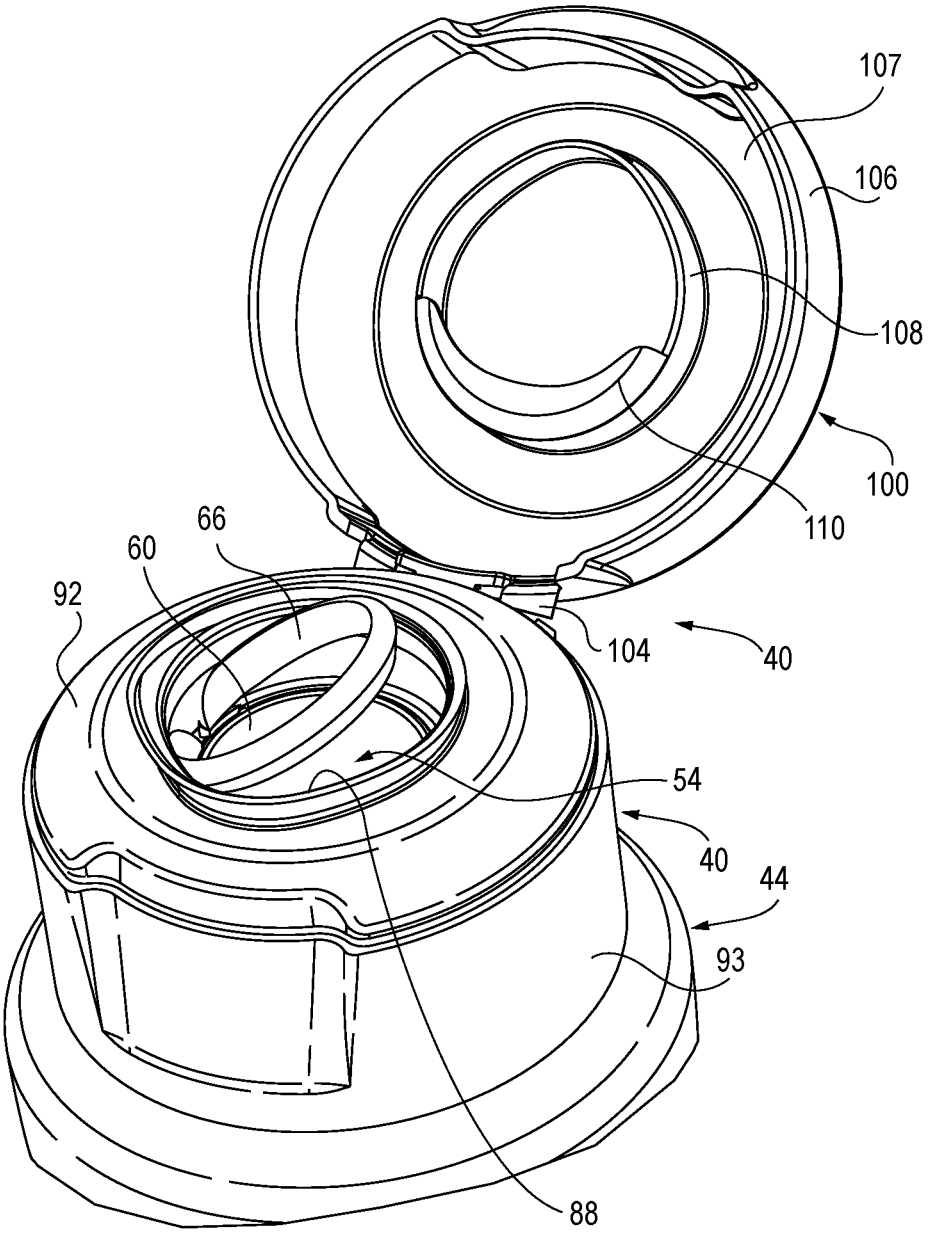
FIG. 1 is an isometric view, taken from above, of a first embodiment of a dispensing closure according to the present invention installed on a fragmentary upper portion of a container.

For ease of description, many figures illustrating the invention show embodiments of a dispensing closure (or simply referred to herein as a "closure") 40 in the typical orientation that the closure 40 would have when located at the opening of a container 44 such as an upright bottle, and terms such as "inward", "outward", "upper", "lower", "axial", "radial", "lateral", etc., are used with reference to this orientation. The term "axially inward" is to be understood as in the direction along a central axis "A" extending vertically through the center of the separable membrane of the closure 40, toward the interior of the container 44 when the closure 40 is mounted atop the opening of the container 44, as is illustrated in FIG. 1. The term "axially outward" is to be understood as in the opposite direction along the central axis "A", away from the interior of the container 44. The term "radially inward" is to be understood as in the radial direction toward the central axis "A". The term "radially outward" is to be understood as in the radial direction away from the central axis "A". The term "laterally inward" is to be understood as in a direction toward the central axis "A", in a plane normal to the central axis "A". The term "laterally outward" is to be understood as in a direction away from the central axis "A", in a plane normal to the central axis "A". It will be understood, however, that the closure of this invention may be manufactured, stored, transported, used, and sold in an orientation other than the specific orientations described and illustrated herein.

The dispensing closure of this invention is especially suitable for use with a variety of conventional or special containers, the details of which, although not fully illustrated or described, would be apparent to those having skill in the art and an understanding of such containers. The particular container illustrated is not intended to limit the present invention. It will also be understood by those of ordinary skill that novel and non-obvious inventive aspects are embodied in the described closure alone.

The dispensing closure described herein is especially suitable for use in dispensing fluent substances. Such dispensed fluent substances may be, for example, food additives, a personal care product, an industrial product, a household product, or other types of products. Such substances may be for internal or external use by humans or animals, or for other uses (e.g., activities involving medicine, commercial or household maintenance, agriculture, manufacturing, etc.).

The illustrated preferred embodiment of the dispensing closure 40 of the present invention has the form of an assembly of parts or articles that are configured to be (i) selectively placed or installed at an opening of a container (such as the container 44 in FIGS. 1-7), (ii) breached to permit communication through a dispensing orifice, and (iii) actuated to dispense a fluent substance from the interior of the container through the exposed dispensing orifice. The illustrated container 44 has the form of a bottle that would typically contain the fluent substance. The fluent substance to be dispensed from the closure 40 is not illustrated in the figures because the substance may take a variety of forms. The closure 40 can be mounted to a container 44 with removable or non-removable means or features such as mating threads, snap-fit beads and grooves, toggle clamps, friction fittings, locks, adhesives, welding, non-removable flanges (as illustrated), etc.

It will be understood that the container 44 may be any conventional type, such as a collapsible, flexible pouch, or may be a generally rigid bottle that has somewhat flexible, resilient walls. The container 44, or a portion thereof, may be made from a material suitable for the intended application. For example, the container may be a pouch made from a thin, flexible material (wherein such a material could be a polyethylene terephthalate (PET) film or a polyethylene film and/or an aluminum foil). Alternatively, a more rigid container (e.g., a bottle) could be made from a thicker, less flexible material such as molded polyethylene, polypropylene, polyethylene terephthalate, polyvinylchloride, glass, metal, or other materials.

It is contemplated that typically, after the closure manufacturer would make the dispensing closure 40 (e.g., by molding its components from a thermoplastic polymer or polymers), the manufacturer will then ship the closure 40 to a filler facility at another location where the container 44 would be filled with a product, assembled with the closure 40, and sealed in the form of a package that would be encountered by a customer or user.

Figure 3:
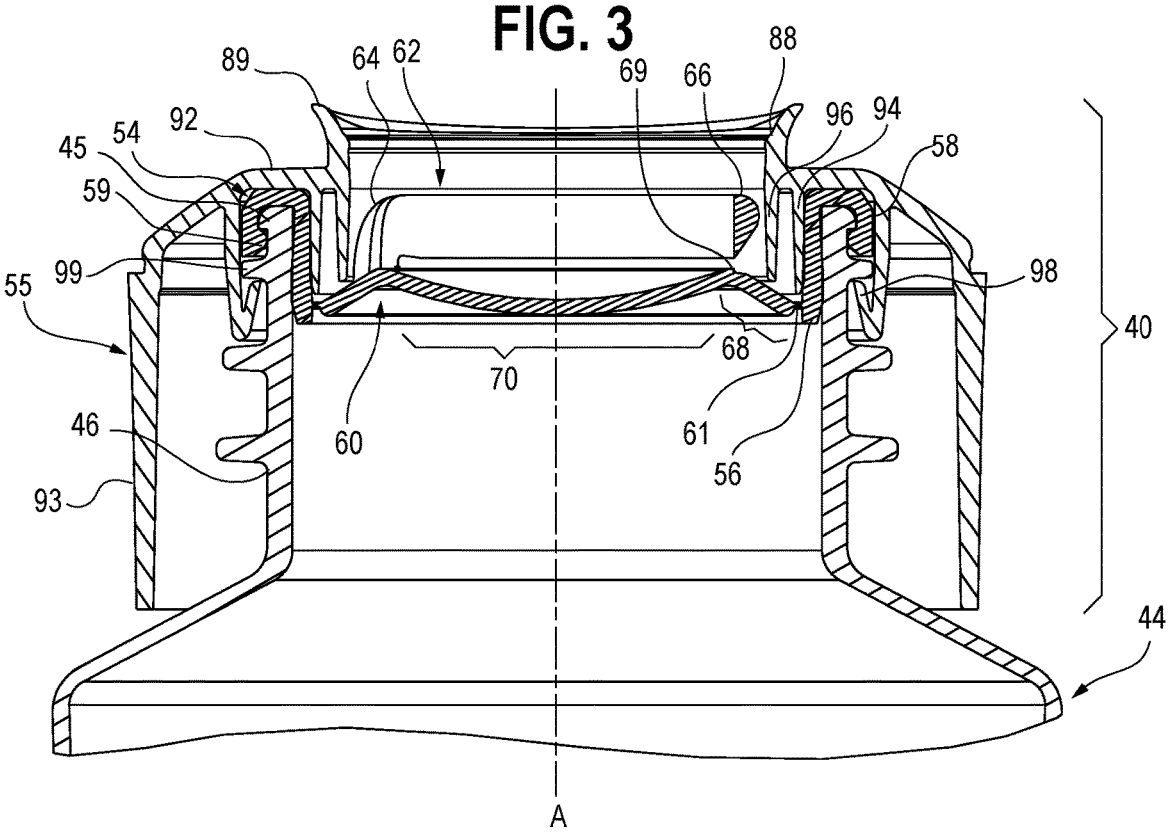
FIG. 3 is a fragmentary, cross-sectional view of the dispensing closure and portion of the container of FIG. 2, taken along plane 3-3 in FIG. 2.

With reference to the accompanying FIG. 3, the illustrated, preferred embodiment of the dispensing closure 40 includes the main components of (i) a fitment or first body 54 for being received within the opening of a container 44, and (ii) an overclosure or second body 55 for surrounding and covering at least a portion of the first body 54. As will be discussed in greater detail hereinafter, a separable portion of the first body 54 can be removed by a user through the opened second body 55 to permit communication of a fluent substance from the interior of the container 44 through the opened closure 40.

Still referring to FIG. 3, the fitment or first body 54 of the closure 40 is cylindrical with a cuplike shape. The first body 54 includes an annular, plug wall or first peripheral wall 56 for being received within, and making sealing contact with, the opening of the container 44. The first body 54 further includes a second peripheral wall 58 that is connected to, and surrounds, the first peripheral wall 56. The first and second peripheral walls 56 and 58 define an annular recess therebetween for receiving a portion of the container 44 near the opening thereof. An attachment means in the form of a laterally-inwardly extending bead 59 is located on the second peripheral wall 58 for mating with a laterally-outwardly extending bead 45 located on a neck portion 46 of the container 44. Other ordinary or special means of attaching the first body 54 with the container 44 may be used, such as mating threads, adhesives, welding, ribs, friction fitting, etc.

With reference again to FIG. 3, a removable disc or membrane 60 is connected to the bottom end of the first peripheral wall 56 by a frangible or thinned material connection 61. The membrane 60 extends radially inwardly from the connection 61 to occlude the opening of the container 44 when the first body 54 is installed on the container 44. The membrane 60 includes a separation means or member 62 which may take a variety of forms that permit the membrane 60 to be broken or torn away from the connection 61 to the first peripheral wall 56. The separation member 62 preferably includes one or more stems 64 extending axially outwardly from the membrane 60 and a grippable portion 66 that extends laterally from the end of the stems 64. The grippable portion 66 has the form of a grippable ring for receiving a finger of a user of the closure 40. It will be understood, however, that the grippable portion 66 may take the form of another shape that is not a ring, such as a tail, polygon, or other suitable projecting member to be engaged by a user of the closure 40. It will further be appreciated that the stems 64 and grippable portion 66 may be provided in a variety of configurations and extend from the membrane 60 in a variety of configurations.

By providing the separation member 62 in the form of a pair of stems 64 and a grippable portion 66, a user may grip and remove the membrane 60 more easily. It will be understood, however, that in the broadest concept of the present invention, the separation member 62 need not have a discernible stem 64 or grippable portion 66. The separation member 62 may be of any suitable geometry that will allow a user to separate the membrane 60 from the closure body 24 by gripping the separation member 62 between user's thumb and finger, or by gripping or hooking it with a tool.

Figure 4:
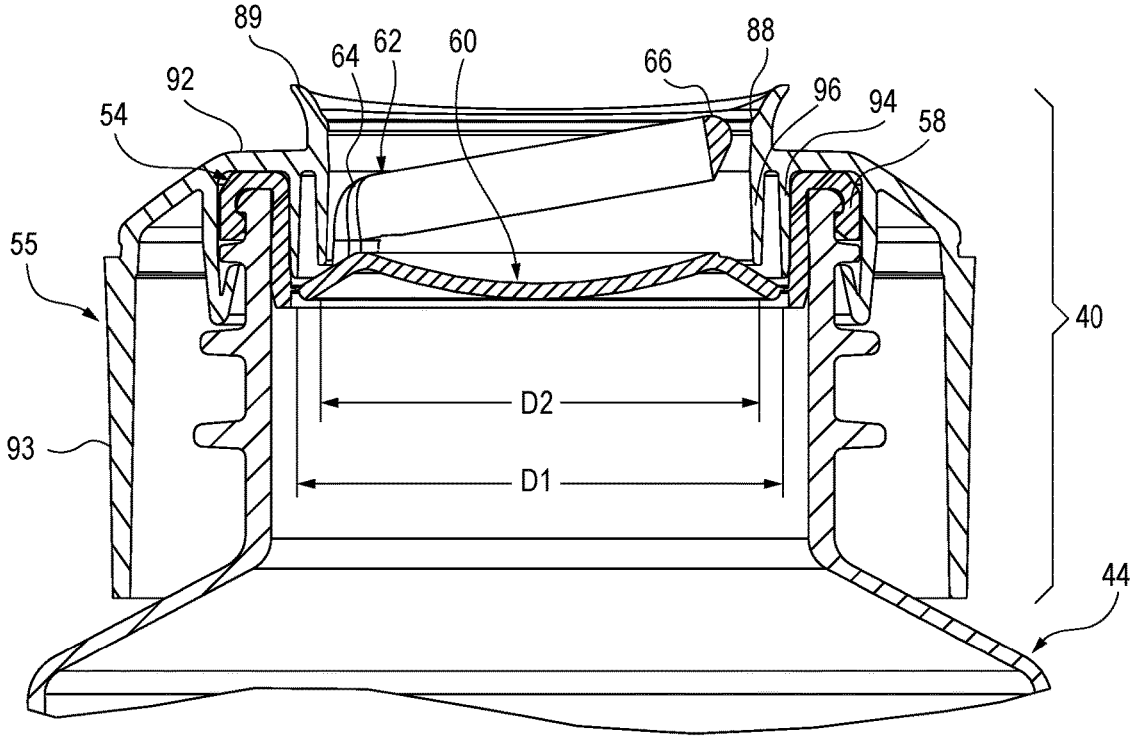
FIG. 4 is a fragmentary, cross-sectional view of the dispensing closure and container that is similar to FIG. 3, however.
Figure 5:
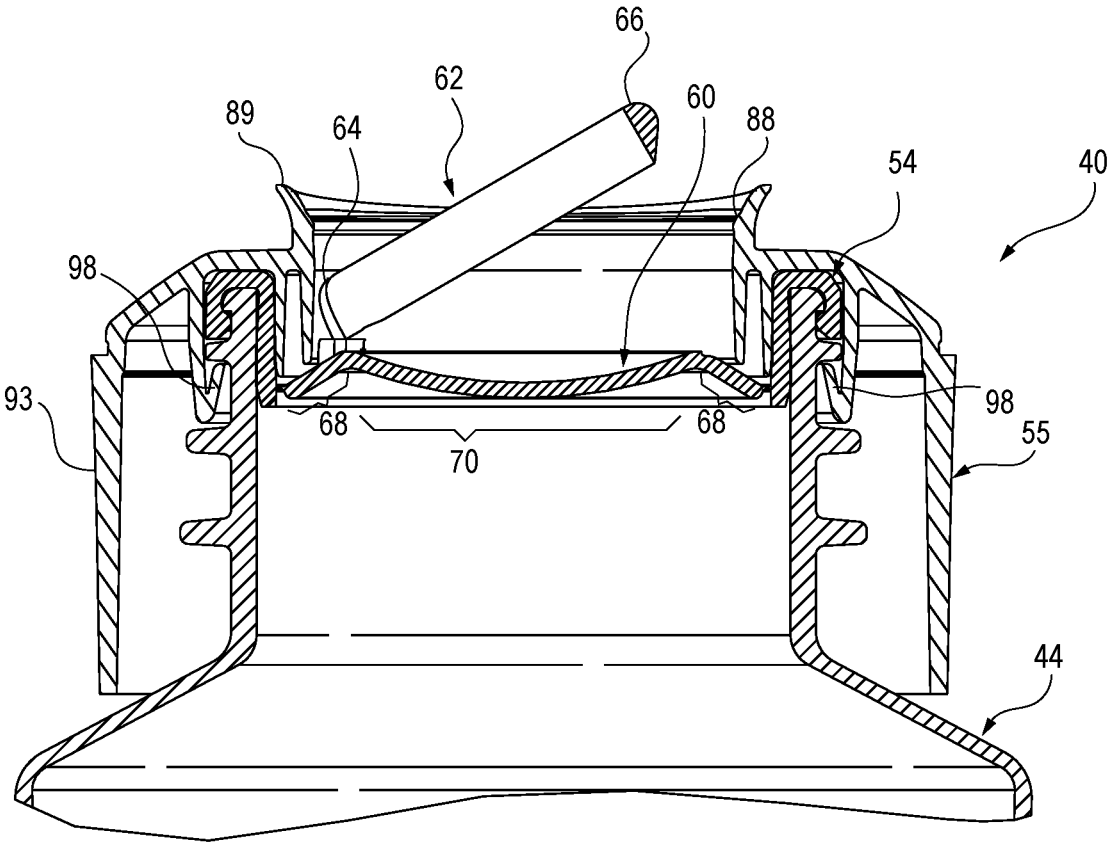
FIG. 5 is a fragmentary, cross-sectional view of the dispensing closure and container similar to FIG. 4, however.
Figure 6:
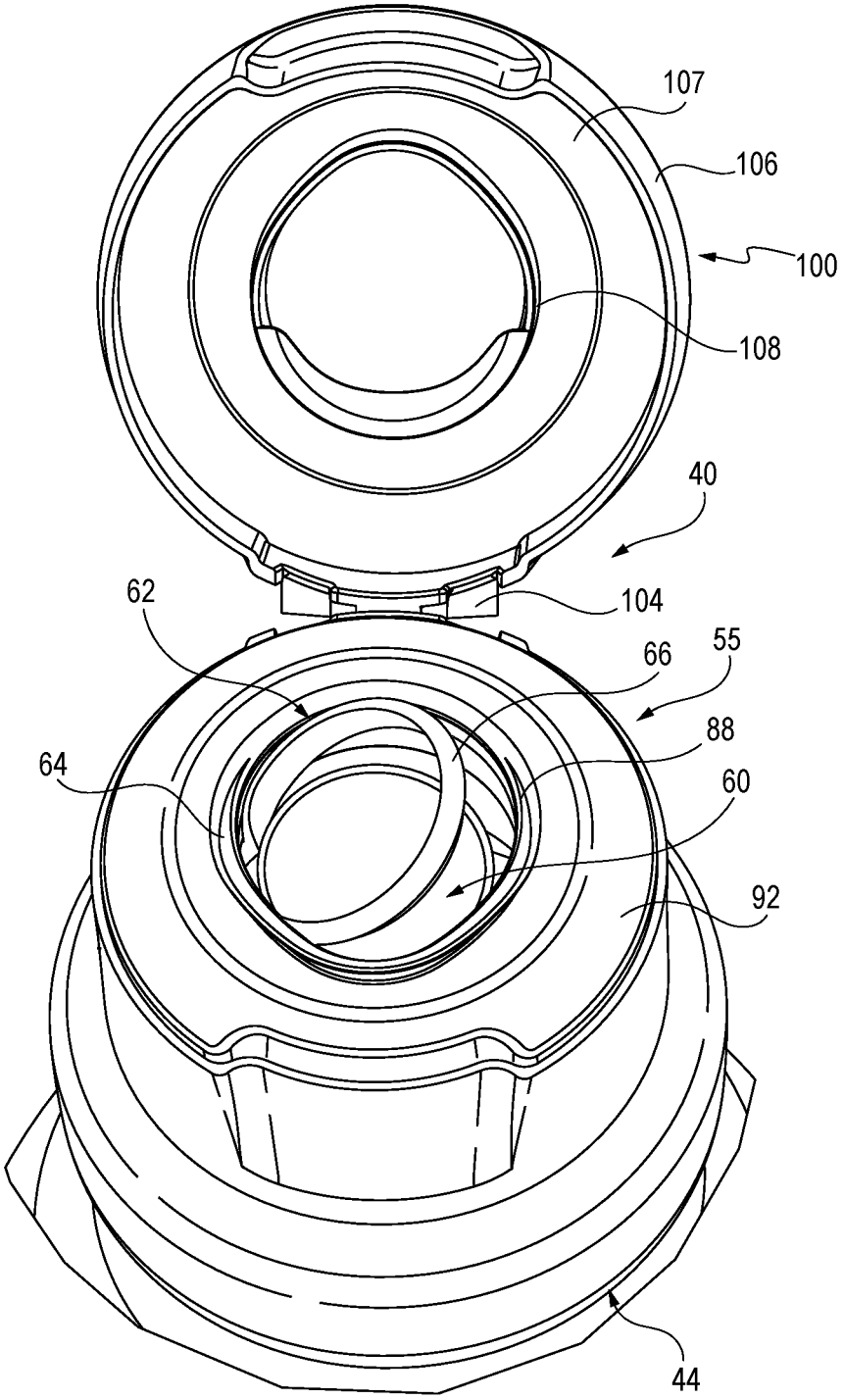
FIG. 6 is a fragmentary, isometric view, taken from above, of the closure and container of FIG. 5.

As further illustrated in FIG. 3, the membrane 60 advantageously includes an annular peripheral portion 68 that is located adjacent to the first peripheral wall 56 and which slopes axially outwardly (away from the container interior) along the central axis "A" when moving in a radial direction moving away from the first peripheral wall 56 toward the central axis "A". The membrane 60 defines a first diameter D1 (FIG. 4) at the frangible connection 61 between the annular peripheral portion 68 and the first peripheral wall 56, as measured in the plane normal to the central axis "A". The membrane 60 further includes a concave central portion 70 that slopes axially inwardly (toward the container interior) in the direction from the annular peripheral portion 68 toward the central axis "A". The inventors have found that providing the membrane 60 with such a sloping, annular peripheral portion 68 as illustrated in FIGS. 3-5 allows the membrane 60 to fold and be easily pulled through relatively small dispensing orifices having a diameter that is smaller than the diameter D1 by a user of the closure 40.

Referring next to FIG. 3, the membrane 60 includes a locally thinned region or bend point 69 located at the axially outermost end of the peripheral portion 68 for encouraging folding of the membrane 60 at that location during separation from the rest of the first body 54, as will be discussed in greater detail hereinafter. The bend 69 has the form of a fully annular region of thinned material in the illustrated, preferred embodiment, however, it will be understood that the bend point 69 may be one or more discrete points or sections extending around the axis "A" that perform a similar function to assist in folding of the membrane 60.

It will be understood that while the membrane 60 in the illustrated, preferred embodiment of the closure 40 is generally disc shaped, the membrane 60 may have other non-circular shapes for occluding a non-circular opening defined by the wall 56.

Figure 2:
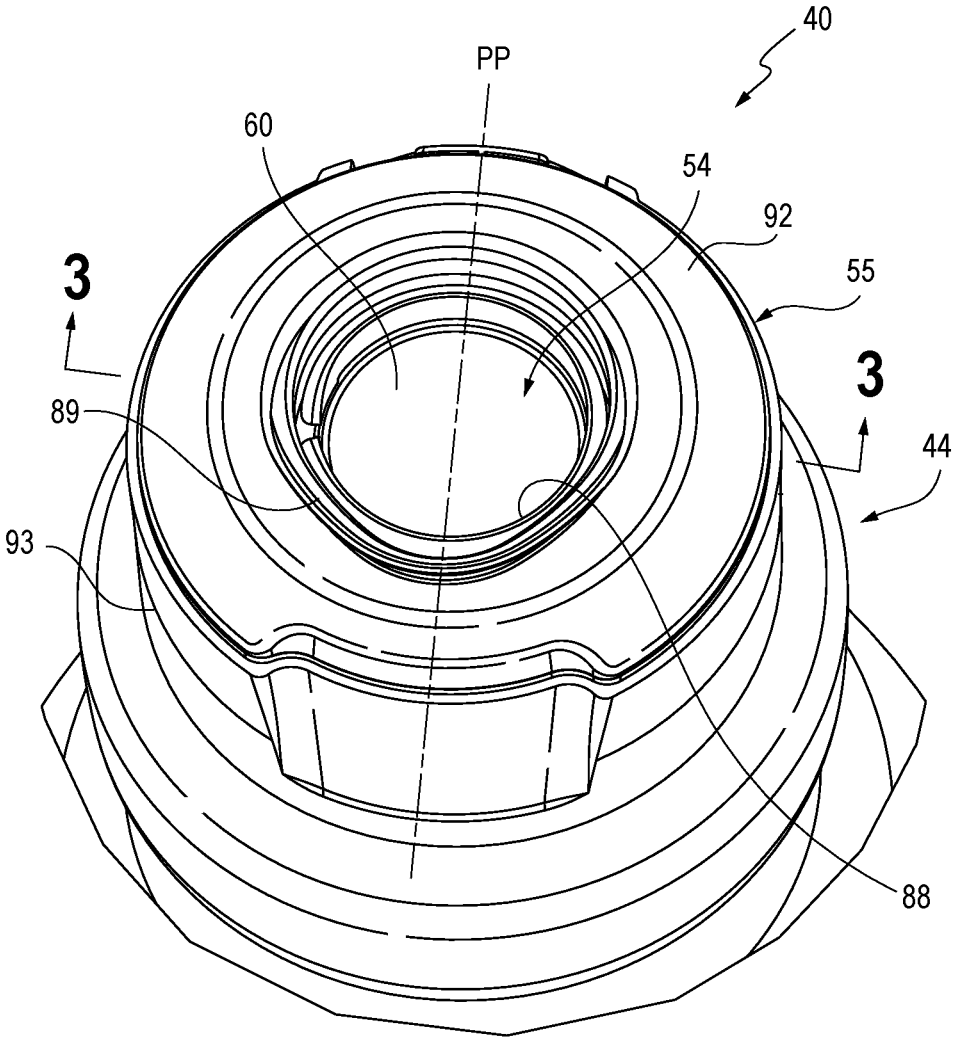
FIG. 2 is a fragmentary, isometric view, taken from above, of the closure and container of FIG. 1, and FIG. 2 omits the lid of the closure.

With reference now to FIGS. 1-3, the overcap or second body 55 of the closure 40 is generally cylindrical, hollow and surrounds portions of the fitment or first body 54. The second body 55 defines a dispensing orifice 88 which is occluded or covered by the membrane 60 of the first body 54 prior to separation of the membrane 60 from the first peripheral wall 56. A pour lip 89 extends axially and laterally outwardly from a top deck 92 around the perimeter of the dispensing orifice 88 and defines a pour path "PP" for directing flow of a fluent substance through the second body 55 upon removal of the membrane 60 from the closure 40.

Referring now to FIG. 3, the top deck 92 of the second body 55 connects to an outer wall or skirt 93 which surrounds the top end 46 of the container 44 and the first body 54 when the assembled closure 40 is installed at the opening of the container 44 (as illustrated in FIG. 3). The skirt 93 surrounds a pair of concentric walls 94 and 96 that extend axially inwardly below the top deck 92 toward the membrane 60. One of the pair of concentric walls 94 engages and seals against the first peripheral wall 56 of the first body 54. The other one of the pair of concentric walls 96 is located axially above the annular peripheral portion 68 of the membrane 60. As will be discussed hereinafter, the wall 96 functions to conceal the broken or torn connection 61 between the membrane 60 and the wall 56 after removal of the membrane 60 by a user. The inventors have found that the broken or torn connection between the membrane 60 and the remainder of the first body 54 may accumulate residual product during dispensing, and the wall 96 extends axially inwardly of the dispensing orifice 88 to conceal any such residual product from a user looking through the dispensing orifice 88.

In some non-preferred forms of the invention, not illustrated, the pair of concentric walls 94 and 96 may have the form of a unitary annular wall that functions to conceal any such residual product from a user looking through the dispensing orifice 88. Such a design would not be preferred due to increased part weight and plastic resin used, compared to the illustrated preferred embodiment. In other forms, the concentric walls 94 and 96 could be connected by a transverse wall located proximate to the membrane 60, and would have an opening above such a transverse wall at the deck 92 for molding.

Referring again to FIG. 3, the second body 55 further includes an attachment means in the form of a non-removable band or flange 98 for mating with a corresponding annular flange or shoulder 99 extending laterally outwardly from the neck of the container 44. It will be understood that the second body 55 may have other removable or non-removable attachment means or features for securing the body 55 with the container 44 and/or the first body 54, such as mating threads, snap-fit beads and grooves, toggle clamps, friction fittings, locks, adhesives, welding, or non-removable flanges (as illustrated), etc.

Referring next to FIG. 4, it can be seen that the dispensing orifice 88 defines a second diameter "D2" in a plane that is normal to the central axis "A", and the second diameter "D2" is substantially smaller than the diameter "D1" defined by the peripheral portion 68 of the membrane 60. The inventors have found that engagement of the wall 96 with the peripheral portion 68 of the membrane 60 during initial breach of the membrane 60 by a user directs the applied removal force toward the center of the membrane 60 which may reduce the initial tear force that is required by the user to remove the membrane 60 by breaking the connection 61.

With reference now to FIG. 1, the second body 55 includes a lid 100 that is connected to the top deck 92 by a hinge 104. The hinge 104 is molded unitarily with the lid 100 and the second body 55 at the top deck 92 so as to accommodate movement of the lid 100 between an open position (e.g., FIG. 1) exposing the dispensing orifice 88, and a closed position (not illustrated) occluding or covering the dispensing orifice 88 of the second body 55. The hinge 104 may be of any suitable conventional or special design. For example, the hinge 104 illustrated in the Figures may be of a conventional snap-action type such as described in the U.S. Pat. Nos. 5,356,017 or 5,642,824, the details of which form no part of the present invention. The hinge 104 could also be a non-snap-action type, such as a strap or tether. The lid 100 includes an annular wall 106 terminating at a top end 107. The top end 107 includes a hollow plug seal 108 that extends axially inwardly therefrom to seal the dispensing orifice 88 when the lid 100 is in its closed position. The second body 55 in the region surrounding the dispensing orifice 88 and/or the lid plug seal 108 are sufficiently flexible to accommodate elastic deformation to establish a leak-tight seal therebetween. The lid 100 may have other latching means such as snap fit beads, locks, tabs, etc. The lid 100 may mated with the second body 55 in a wholly removable manner, such as mating screw threads, friction or snap fit beads, etc. The lid 100 may be omitted altogether in some non-preferred applications.

Referring still to FIG. 1, the lid plug seal 108 is provided with a drip catching means in the form of a transverse wall 110 that extends partially around a rear portion of the plug seal 108 (proximate the hinge 104).

The first body 54 and second body 55 are preferably formed or molded from a suitable thermoplastic material such as polypropylene or polyethylene. Other materials may be employed instead. It will be understood that in alternative designs (not illustrated), one or more of the basic components or sub-components may be separately or sequentially formed or molded (such as through bi-injection molding). Alternatively, in a non-preferred embodiment, the basic components may be molded initially as one connected, unitary structure, and then broken apart, and then re-assembled into an operative combination or assembly.

One method of assembling the closure 40 with a container 44 of a fluent substance to form a package that would be encountered by a customer or user is next discussed. It will be understood that the method of assembly described herein is illustrative only, and there may be other methods of assembling the package. The closure 40, including the first body 54 and the second body 55, are preferably molded as separate articles of manufacture and shipped to a filler facility. The plug seal 108 of the lid 100 is then placed into a sealing, frictional engagement with the dispensing orifice 88 of the second body 55 prior to shipping. The filler facility then fills the interior of the container 44 with a pre-determined amount or dose of a substance to be dispensed (not illustrated). The first and second peripheral walls 56 and 58 of the first body 54 are axially installed around the neck 46 of the container 44 such that the bead 59 of the first body 54 engages and slips beneath the bead 45 of the container 44, and the first peripheral wall 56 seals against the opening of the container 44.

The overclosure or second body 55 is then axially installed around the top end of the container 44 such that the non-removable attachment flange 98 slips beneath and engages the underside of the flange 99 on the neck 46 of the container 44 such that the first concentric wall 94 seals against the first body 54 and the second concentric wall 96 is positioned axially above the sloping peripheral portion 68 of the membrane 60. Advantageously, the present invention design of the closure 40 does not require that the first and second bodies 54 and 55, respectively, be oriented in any specific rotational arrangement. Accordingly, the separation member 62 may be asymmetric relative to a vertical plane extending through the central axis "A" and the pour path "PP", reducing the cost and complexity of assembling the closure 40.

The filled container 44 with the closure 40 installed in the closed position is thus provided to the consumer in the form a completed package.

The detailed operation and function of the closure 40 will next be described. Typically, a user, such as a customer, will encounter the closure 40 installed upon the fluent substance container 44 as a package with the lid 100 in the closed position (not illustrated). The user would open the lid 100 by rotating it relative to the top deck 92 about the hinge 104 into an open position to disengage the plug seal 108 from the dispensing orifice 88.

Figure 7:
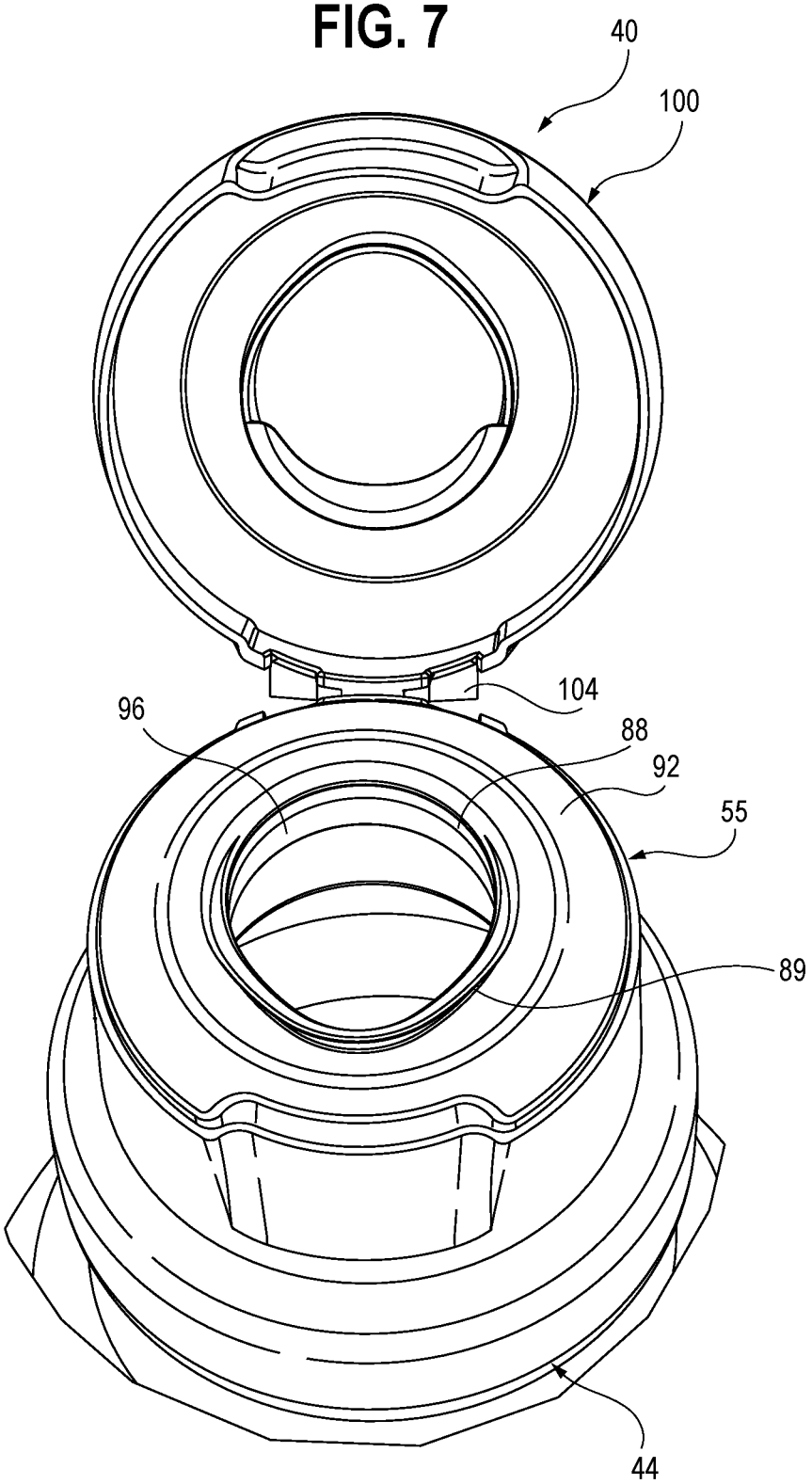
FIG. 7 is a fragmentary, isometric view, taken from above, of the closure and container similar to FIG. 6, however.
Figure 8:
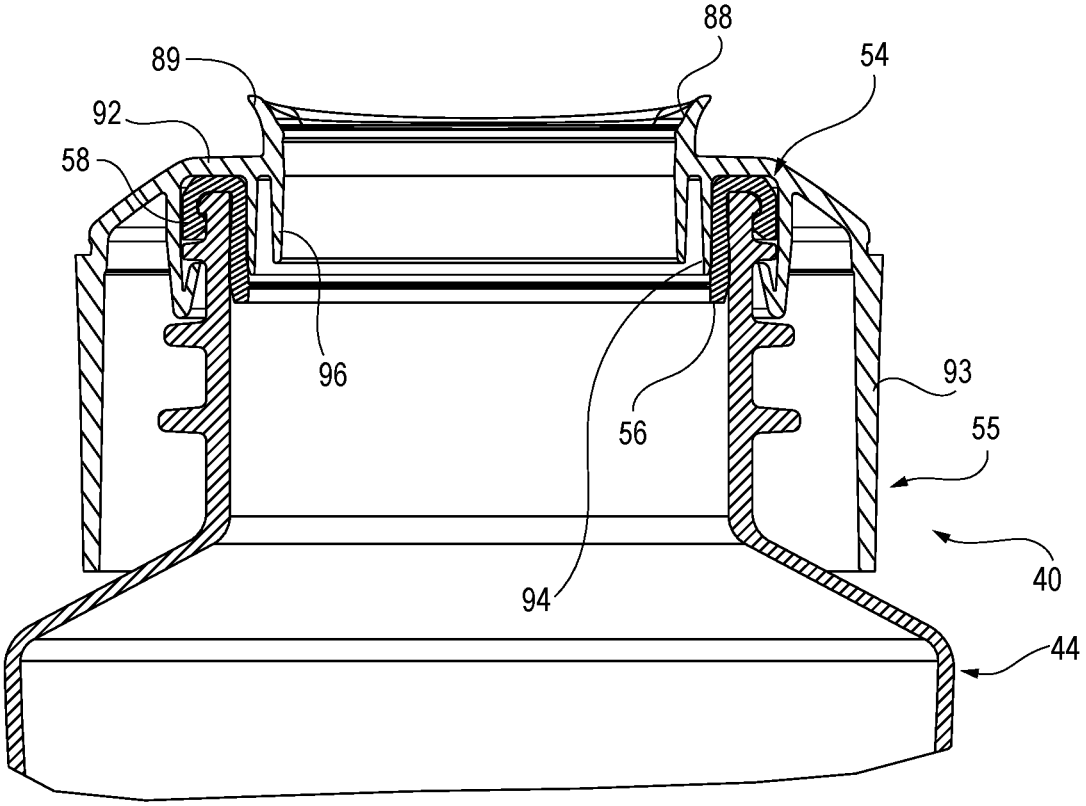
FIG. 8 is a fragmentary, cross-sectional view of the dispensing closure and container similar to FIG. 3, however.
Figure 9:
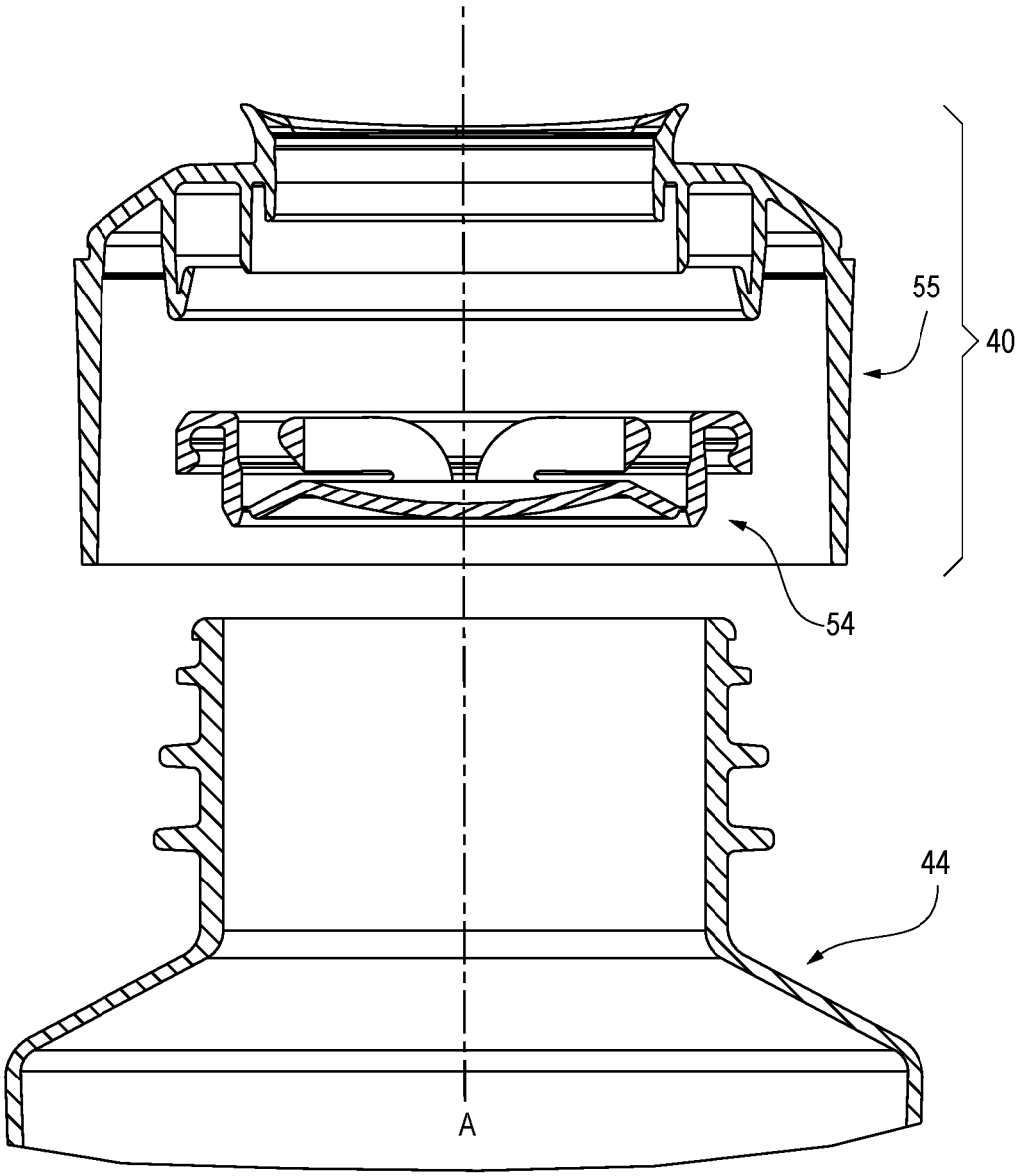
FIG. 9 is an exploded, cross-sectional view of the dispensing closure and fragmentary portion of the container of FIG. 3.

With reference to FIGS. 2-6, the user would then grip and lift upwardly on the grippable ring 66. The sloping peripheral portion 68 would make contact with the wall 96 of the second body 55 to reduce the force required to initiate the tear or break the connection 61 (FIG. 3) between the membrane 60 and the remainder of the first body 54 (as compared to a generally planar membrane having an identical frangible connection and formed of the same material). As the user continues to lift upwardly on the grippable ring 66, the peripheral portion 68 of the membrane 60 would slide upwardly against the wall 96, which guides the membrane out of the opened dispensing orifice 88 (FIGS. 7 and 8).

The user may grasp and tilt the container 44, and pour an amount of fluent substance from the interior of the container 44 through the exposed orifice 88 along the pour path "PP" defined by the pour lip 89.

After dispensing the fluent substance through the closure 40, the user may then return the lid 100 to its closed position by rotating the lid 100 about the hinge 104 relative to the top deck 92 such that the lid plug seal 108 re-seals around in the orifice 88.

Figure 10:
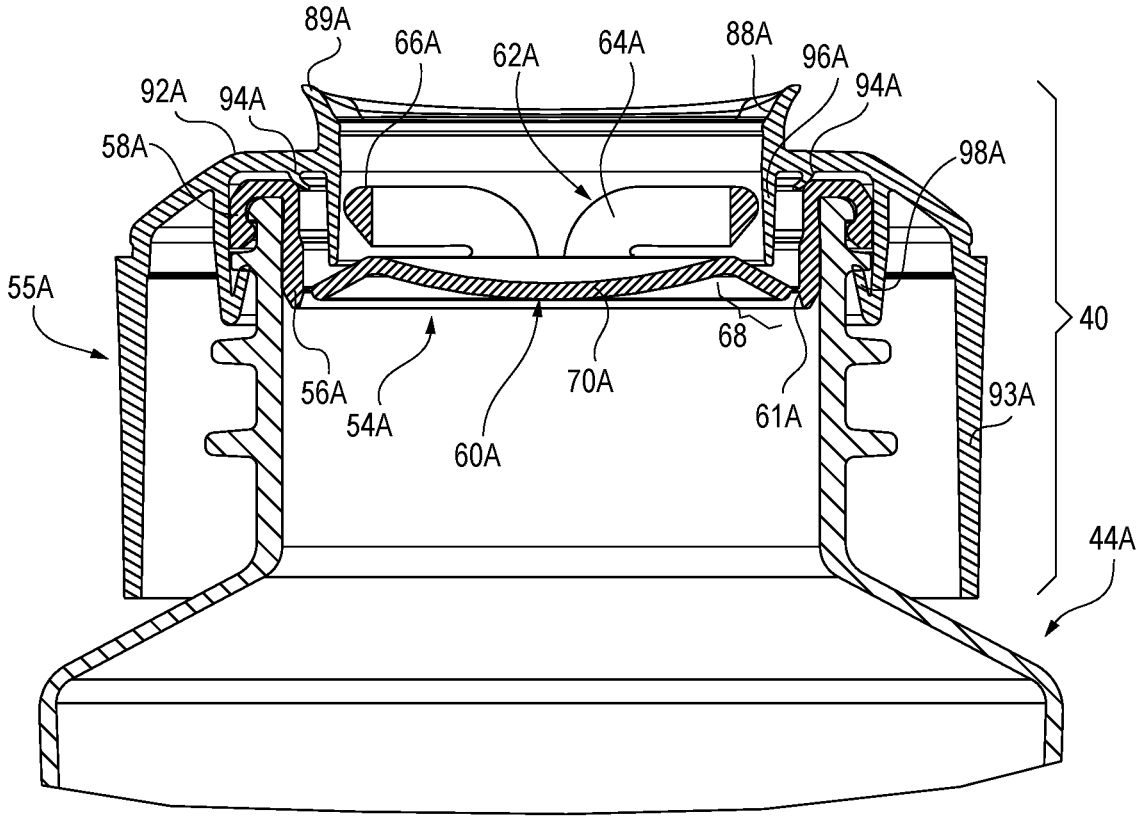
FIG. 10 is a fragmentary, cross-sectional view of a second embodiment of a dispensing closure according to the present invention installed on a fragmentary upper portion of a container.

A second embodiment of a closure 40A according to the present invention is illustrated in FIG. 10, which has a modified sealing arrangement between the first body 54A and the second body 55A, but is otherwise the same as the previously discussed first embodiment of the closure 40. Like elements between the first illustrated embodiment of the closure 40 and the second illustrated embodiment of the closure 40A are designated with the same numeral (the first embodiment numbered features having no suffix and the second embodiment having numbered features with an "A" suffix). The second illustrated embodiment of the closure 40A has the same basic elements as the first illustrated embodiment of the closure 40, namely a first body 54A installed within the opening of the container 44A and a second body 55A covering the first body 54A. The optional lid is not visible out of the plane of view. It will be understood that the features of the closure 40A that are not visible in FIG. 10 are identical to that of the closure 40 described above.

Still referring to FIG. 10, the second illustrated embodiment of the closure 40A differs from the first illustrated embodiment of the closure 40 in that the second body 55A includes only one wall 96A extending downwardly from the top deck 92A, which is located axially above the annular peripheral portion 68A of the membrane 60A to conceal the frangible connection 61A. The second body 55A includes a flexible seal or crab's claw seal 94A extending from the underside of the top deck 92A to seal against the first peripheral wall 56A of the first body 54A. Other sealing arrangements are contemplated.

Figure 11:
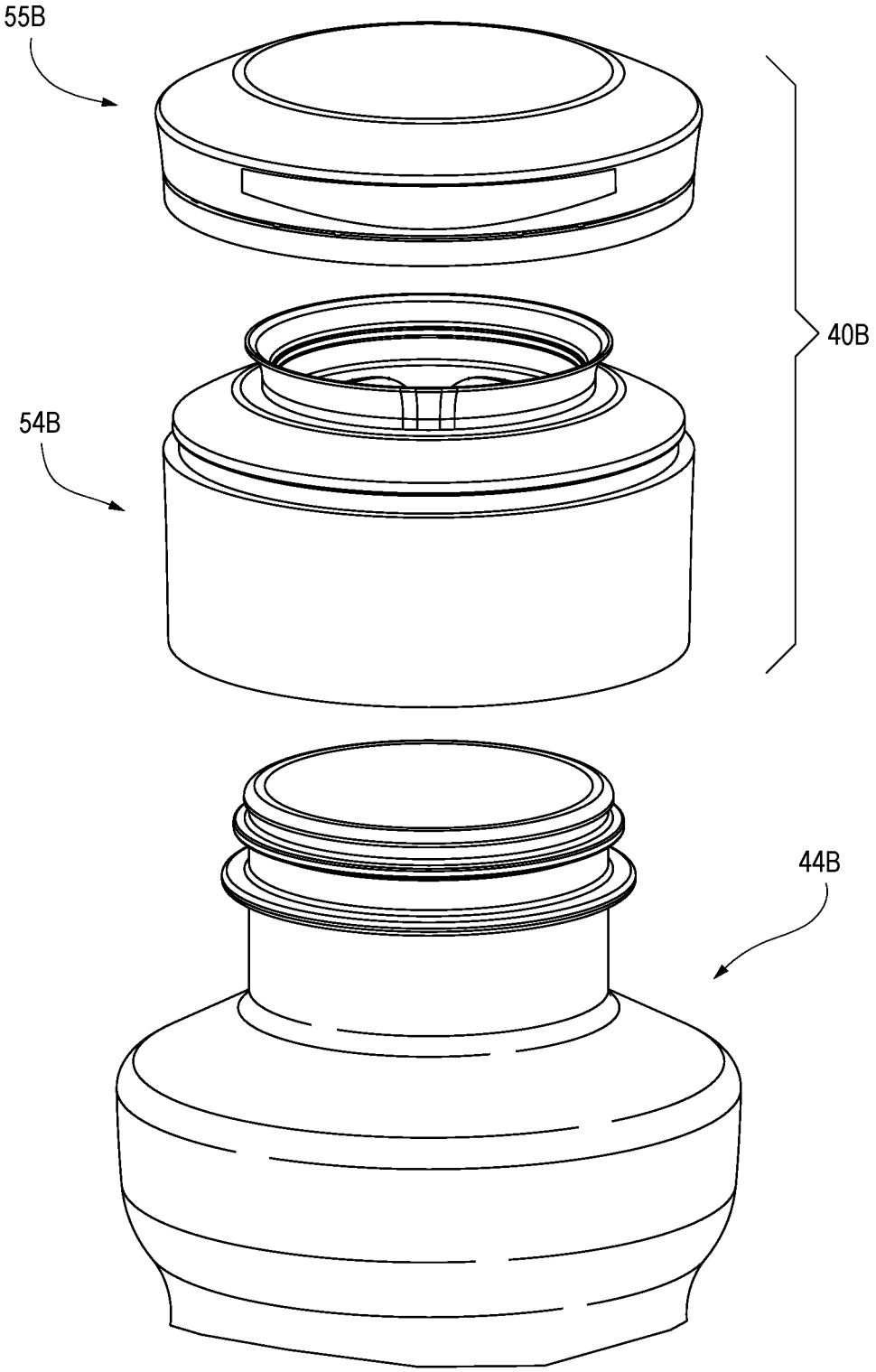
FIG. 11 is an exploded view of a third embodiment of a dispensing closure according to the present invention for being installed on a fragmentary portion of the container.
Figure 12:
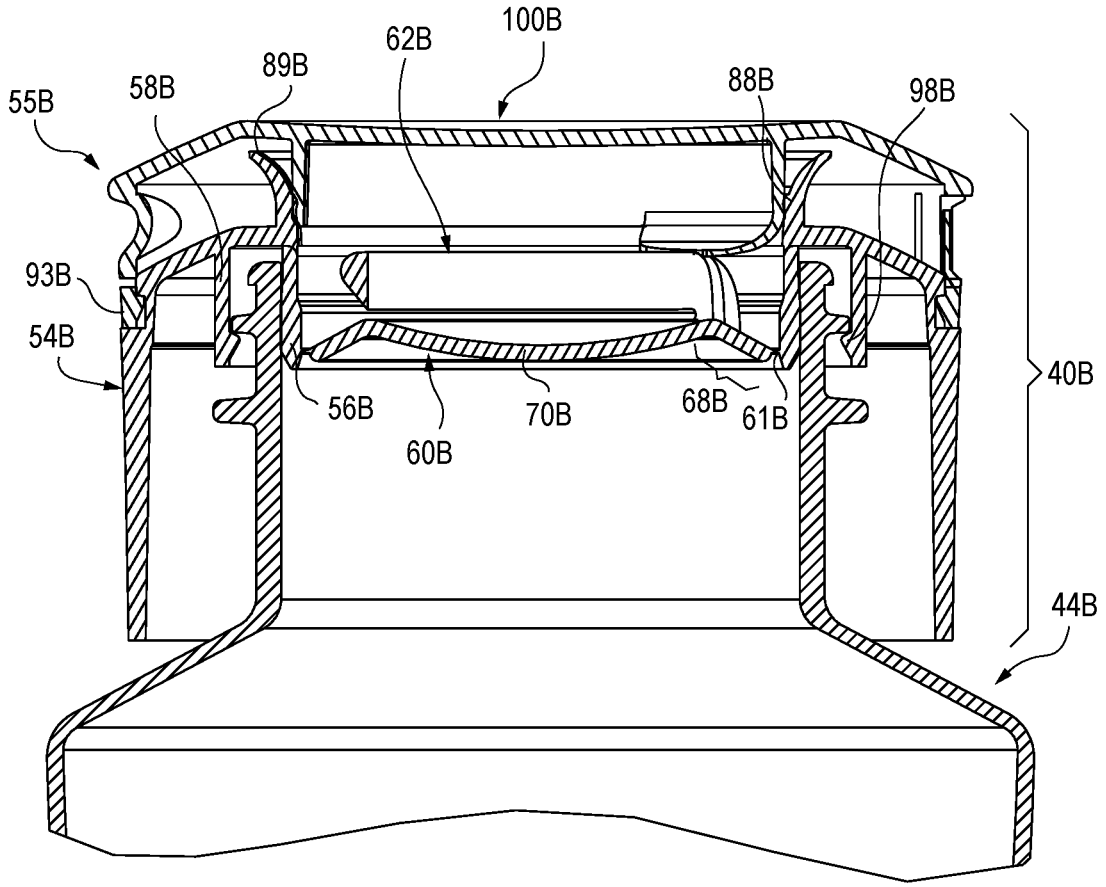
FIG. 12 is a cross-sectional view of the dispensing closure and fragmentary portion of a container of FIG. 11 in an assembled configuration in the form of a package.
Figure 13:
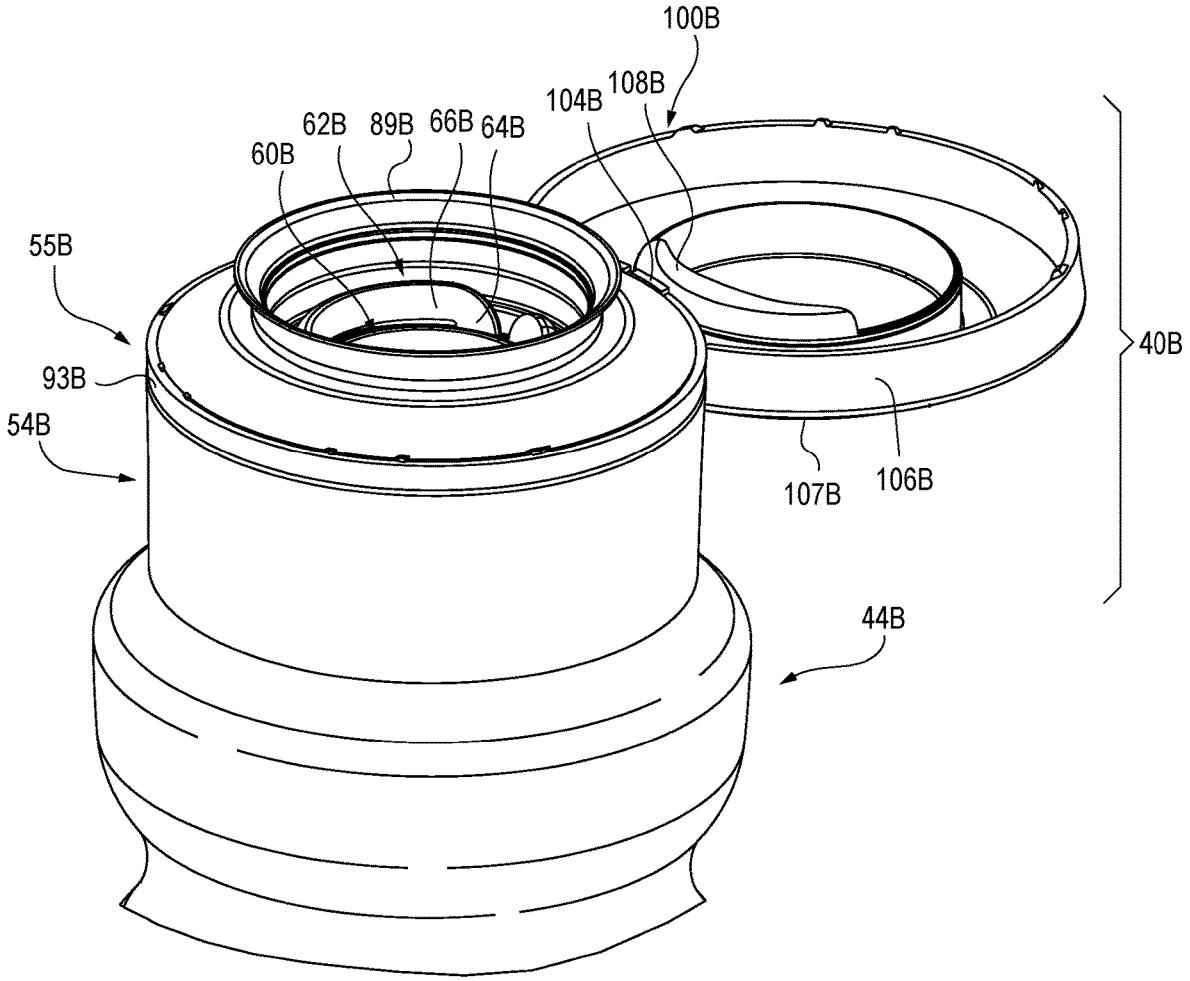
FIG. 13 is a fragmentary, isometric view, taken from above, of the closure and container of FIG. 12, however.

A third embodiment of a closure 40B according to the present invention is illustrated in FIG. 11-13, which has a modified arrangement of the first body 54B and the second body 55B that may provide improved aseptic packaging features, but otherwise functions in a similar manner as the previously discussed first embodiment of the closure 40. Like elements between the first illustrated embodiment of the closure 40 and the third illustrated embodiment of the closure 40B are designated with the same numeral (the first embodiment numbered features having no suffix and the third embodiment having numbered features with a "B" suffix). The third illustrated embodiment of the closure 40B has the same basic elements as the first illustrated embodiment of the closure 40, namely a first body 54B installed within the opening of the container 44B and a second body 55B covering the first body 54B.

Referring now to FIG. 12, the third illustrated embodiment of the closure 402 differs from the first illustrated embodiment of the closure 40 in that the first body 54B has a completely circular dispensing orifice 88B and pour lip 89B and the second body 55B is molded closed for being installed over the first body 54B in any angular orientation along the central axis "A" (FIG. 11) which permits pouring at any angle from the pour lip 89B. Furthermore, the second body 55B includes a short skirt 93B frangibly connected to the lid 100B. The user would break the frangible connections when rotating the lid 100B away from the skirt 93B during initial opening of the closure 40B. The arrangement of the first body 54B and the second body 55B advantageously allows for a greater opening angle of the lid 1002 relative to the remainder of the second body 55B in the open position or configuration (as shown in FIG. 13) and provide an additional tamper evidence indication to a user of the closure 40B. In addition, the arrangement of the first body 54B and the second body 55B advantageously allows for a more apparent two-color design that is readily noticed by a user of the closure 40B.

Other configurations of the present invention are set forth in the claims.

Various modifications and alterations to this invention will become apparent to those skilled in the art without departing from the scope and spirit of this invention. Illustrative embodiments and examples of the system are provided as examples only and are not intended to limit the scope of the present invention.

The invention claimed is:

1. A dispensing closure for use in dispensing a substance that may be stored within an interior of a container, said dispensing closure comprising:

a first body for being located at an opening of a container, said first body having a first peripheral wall and a membrane that is connected to said first peripheral wall to initially occlude access to the interior of the container, said membrane defining a central axis and including a separation member that accommodates engagement by a user to separate said membrane from said first peripheral wall to permit access to the interior of the container, and said membrane having an annular peripheral portion adjacent said first peripheral wall that slopes axially outwardly along said central axis in a radial direction moving away from said first peripheral wall toward said central axis, wherein said membrane includes a central portion that slopes axially inwardly from said annular peripheral portion.

2. The dispensing closure of claim 1 wherein said first body further includes a second peripheral wall connected to, and surrounding, said first peripheral wall, said first and second peripheral walls for receiving a portion of the container to secure said first body at the opening of the container.

3. The dispensing closure of claim 1 wherein said separation member includes at least one stem extending outwardly from said membrane and a grippable ring extending laterally from said at least one stem.

4. The dispensing closure of claim 1 further comprising a second body for surrounding at least a portion of said first body and defining a dispensing orifice.

5. The dispensing closure of claim 4 wherein said second body includes a top deck and at least one wall extending axially inwardly toward said membrane.

6. The dispensing closure of claim 5 wherein said at least one wall includes a pair of concentric walls, wherein one of said pair of concentric walls engages said first peripheral wall and the other one of said pair of concentric walls is located above said annular peripheral portion of said membrane.

7. The dispensing closure of claim 5 wherein said at least one wall conceals the connection of said annular peripheral portion to said first peripheral wall of said first body.

8. The dispensing closure of claim 4 wherein said membrane defines a first diameter at said annular peripheral portion connection to said first peripheral wall, and said dispensing orifice defines a second diameter that is smaller than said first diameter.

9. A dispensing closure for use in dispensing a substance that may be stored within an interior of a container, said dispensing closure comprising:

a first body for being located at an opening of a container, said first body having a first peripheral wall and a membrane that is connected to said first peripheral wall to initially occlude access to the interior of the container, said membrane defining a central axis and including a separation member that accommodates engagement by a user to separate said membrane from said first peripheral wall to permit access to the interior of the container, and said membrane having an annular peripheral portion adjacent said first peripheral wall that slopes axially outwardly along said central axis in a radial direction moving away from said first peripheral wall toward said central axis; and a second body for surrounding at least a portion of said first body and defining a dispensing orifice, wherein said second body includes a top deck and a skirt extending downwardly from said top deck for surrounding a portion of the container, said second body including a lid rotatably connected to said top deck.

10. The dispensing closure of claim 4 wherein said second body includes a pour lip extending laterally and axially outwardly around said dispensing orifice and defining a pour path.

11. The dispensing closure of claim 10 wherein said separation member is asymmetric relative to a plane extending through said central axis and said pour path.

12. The dispensing closure of claim 4 wherein said second body includes means for being non-removably secured with said first body at an opening of the container.

13. The dispensing closure of claim 4 in combination with a container of a fluent substance, said dispensing closure, container, and fluent substance together defining a package.

14. A dispensing closure for use in dispensing a substance that may be stored within an interior of a container, said dispensing closure comprising: a first body for being located at an opening of a container, said first body having a first peripheral wall and a membrane that is connected to said first peripheral wall to initially occlude access to the interior of the container, said membrane defining a central axis and including a separation member that accommodates engagement by a user to separate said membrane from said first peripheral wall to permit access to the interior of the container, and said membrane having an annular peripheral portion adjacent said first peripheral wall that slopes axially outwardly along said central axis in a radial direction moving away from said first peripheral wall toward said central axis, wherein said membrane includes at least one bend point located at an axially outermost end of said peripheral portion for encouraging folding of said membrane.

15. The dispensing closure of claim 4 wherein said second body includes a top deck having a flexible seal extending axially inwardly therefrom for sealing against said first body.

16. The dispensing closure of claim 4 wherein said second body includes a pour lip that is symmetric about said central axis.

* * * * *